US007165693B2

(12) United States Patent
Oguchi et al.

(10) Patent No.: US 7,165,693 B2
(45) Date of Patent: Jan. 23, 2007

(54) SYNTHETIC RESIN BOTTLE-TYPE CONTAINER WITH IMPROVED DEFORMATION RESISTANCE

(75) Inventors: Hiroki Oguchi, Koto-ku (JP); Takao Iizuka, Koto-ku (JP); Koichi Haraguchi, Matsudo (JP); Tadashi Hayakawa, Matsudo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 0 days.

(21) Appl. No.: 10/531,995

(22) PCT Filed: Oct. 27, 2003

(86) PCT No.: PCT/JP03/13720

§ 371 (c)(1),
(2), (4) Date: Aug. 11, 2005

(87) PCT Pub. No.: WO2004/037658

PCT Pub. Date: May 6, 2004

(65) Prior Publication Data

US 2006/0054587 A1 Mar. 16, 2006

(30) Foreign Application Priority Data

Oct. 28, 2002 (JP) ..... 2002-312779

(51) Int. Cl.
*B65D 1/02* (2006.01)
*B65D 1/42* (2006.01)

(52) U.S. Cl. ..... 215/381; 215/383; 220/675

(58) Field of Classification Search ..... 215/381, 215/384, 398, 900; 220/666, 675, 771, 907
See application file for complete search history.

(56) References Cited

U.S. PATENT DOCUMENTS

| | | | | |
|---|---|---|---|---|
| 3,325,031 | A * | 6/1967 | Singier | 215/247 |
| 5,238,129 | A * | 8/1993 | Ota | 215/381 |
| 5,337,909 | A * | 8/1994 | Vailliencourt | 215/381 |
| 5,381,910 | A * | 1/1995 | Sugiura et al. | 215/398 |
| 2001/0054597 | A1 * | 12/2001 | Ozawa et al. | 215/381 |

FOREIGN PATENT DOCUMENTS

| | | |
|---|---|---|
| JP | U-03-015320 | 2/1991 |
| JP | U 06-1213 | 1/1994 |
| JP | A 06-127542 | 5/1994 |
| JP | A-08-143019 | 6/1996 |
| JP | A-08-310521 | 11/1996 |
| JP | A 09-328115 | 12/1997 |

(Continued)

*Primary Examiner*—Sue A. Weaver
(74) *Attorney, Agent, or Firm*—Oliff & Berridge, PLC

(57) ABSTRACT

A synthetic resin bottle-type container includes a shoulder portion continuous with a mouth portion through which contents can be poured out, and a body portion forms a space for accommodating the contents over an area extending to its bottom wall from the shoulder portion. The body portion includes pressure-reduction absorbing panels defined by at least one groove that projects inwards of the container. For preventing the shoulder portion from deformation due to the absorption of the pressure-reduction, the groove for the pressure-reduction absorbing panel immediately below the shoulder portion is provided with a recess extending along the groove and having a depth larger than that of the groove.

4 Claims, 10 Drawing Sheets

FOREIGN PATENT DOCUMENTS

| | | | |
|---|---|---|---|
| JP | 10058527 A | * | 3/1998 |
| JP | A 11-180428 | | 7/1999 |
| JP | A 2002-193229 | | 7/2002 |
| JP | A-2003-063516 | | 3/2003 |
| WO | WO 00/50309 | * | 8/2000 |

* cited by examiner

A-A

B-B

E-E

F-F

G-G

H-H

I-I

SYNTHETIC RESIN BOTTLE-TYPE CONTAINER WITH IMPROVED DEFORMATION RESISTANCE

BACKGROUND ART

1. Technical Field

The present invention relates to a synthetic resin bottle-type container obtained by molding a synthetic resin, such as polyethylene terephthalate, by biaxial stretch blow molding, and aims at advantageously avoiding occurrence of deformations of the container, particularly deformations on its shoulder portion due to dislocation of pressure reduction absorbing panels.

2. Prior Art

Currently, synthetic resin containers represented by PET bottles are widely used as containers for storing beverages, seasonings, liquors, detergents, medicines, etc., because they are light in weight and easy to handle, they ensure transparency to provide a refined appearance comparable to glass containers, and they can be obtained at low cost.

Moreover, for this type of synthetic resin containers, improvements have been achieved in terms of the heat-resistance so that the containers can be directly filled with relatively hot contents immediately after high-temperature sterilization, without requiring a previous cooling thereof.

Particularly in the case of such containers with improved heat resistance, deformations of the container takes place inevitably, due to reduction of the internal pressure upon cooling of the contents to the room temperature. In order to minimize such deformations, the container body may be provided with at least one groove that is recessed inwards of the container, to thereby define the so-called pressure-reduction absorbing panels.

However, when the containers having the pressure-reduction absorbing panels, particularly the containers of a rectangular cross-section, are provided with the border of the panels close to the shoulder portion, a local indentation of the shoulder portion tend to take place along with the dislocation of the panels upon absorption of the pressure reduction. The containers with locally indented shoulder portion cannot be shipped as marketable products, and thus cause the yield to be lowered.

In the synthetic resin blow molded containers, the shoulder portion has a relatively poor strength since, from the beginning, the wall at the shoulder portion tends to become thin, and the wall itself does not undergo a sufficient stretching as is the case with the container body portion. In this connection, there has been proposed a blow-molded container provided at its shoulder portion with a stepped portion, and the region extending from the stepped portion to the container body portion has a polyhedral shape as defined by triangular panels (see, for example, Japanese Patent Application Publication No. 06-127542). However, due to the progressive demand for the weight reduction of resin containers and a resultant reduced wall thickness at the shoulder portion, large-sized containers with a volume of as large as 1.5 l tend to be severely affected by the dislocation of the panels due to an increased absorption amount of the pressure reduction. Thus, a mere application of the conventional approach would not provide a sufficient solution.

DISCLOSURE OF THE INVENTION

It is an object of the present invention to provide a novel synthetic resin bottle-type container capable of preventing its shoulder portion from deformation due to dislocation of the pressure-reduction absorbing panels.

According to the present invention, there is provided a synthetic resin bottle-type container comprising a shoulder portion continuous with a mouth portion for pouring out contents, and a body portion forms a space for accommodating the contents over an area extending to its bottom wall from said shoulder portion;

said body portion comprising pressure-reduction absorbing panels defined by at least one groove that projects inwards of said container; and said at least one groove comprising a groove for said pressure-reduction absorbing panel which is situated immediately below said shoulder portion, said groove being provided with a recess extending along said groove and having a depth larger than that of the groove.

It is preferred that the recess has a width which is substantially the same as that of said groove.

It is further preferred that the recess has a slope inclined from its outer surface toward a bottom of said groove, for preventing shrinkage.

BRIEF DESCRIPTION OF THE DRAWINGS

The present invention will be described in detail below by means of preferred embodiments with reference to the accompanying drawings.

BEST MODE FOR CARRYING OUT THE INVENTION

Figure 1:
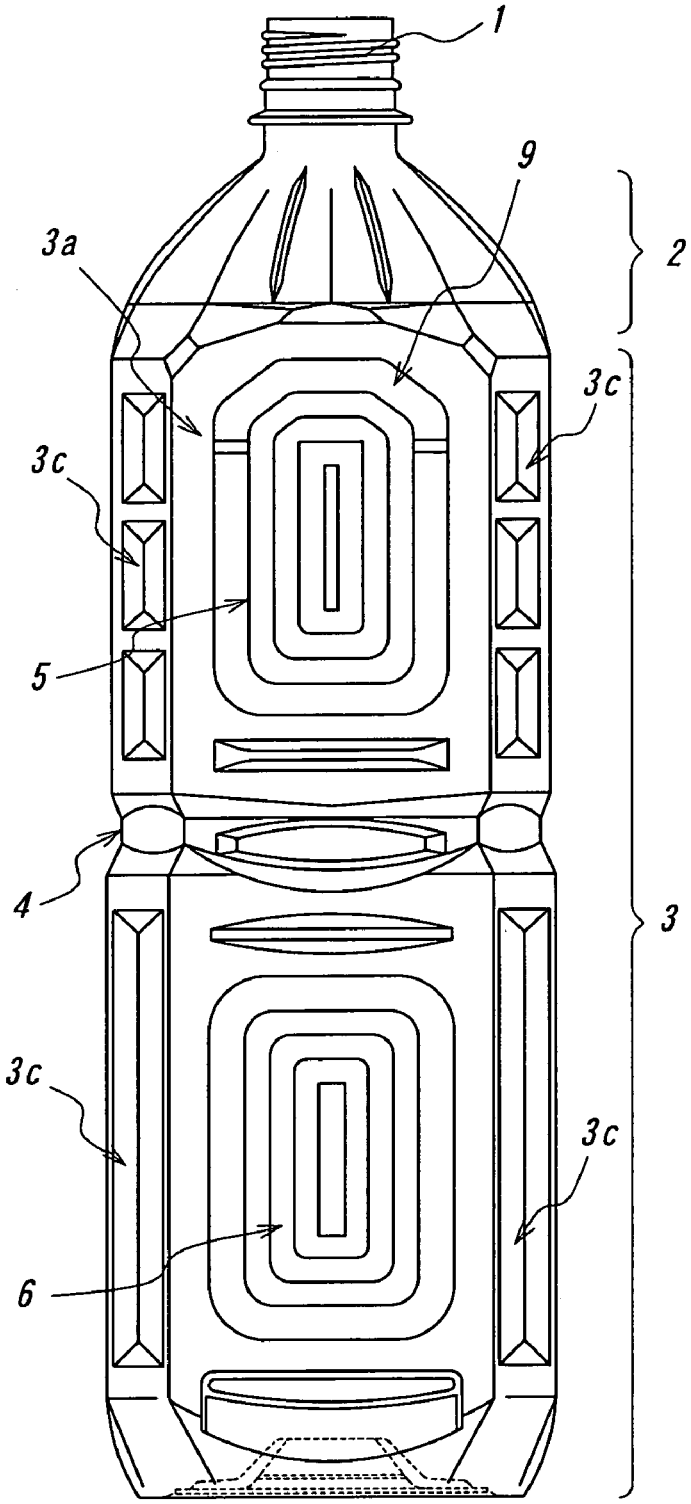
FIG. 1 illustrates a container according to one embodiment of the present invention.
Figure 2:
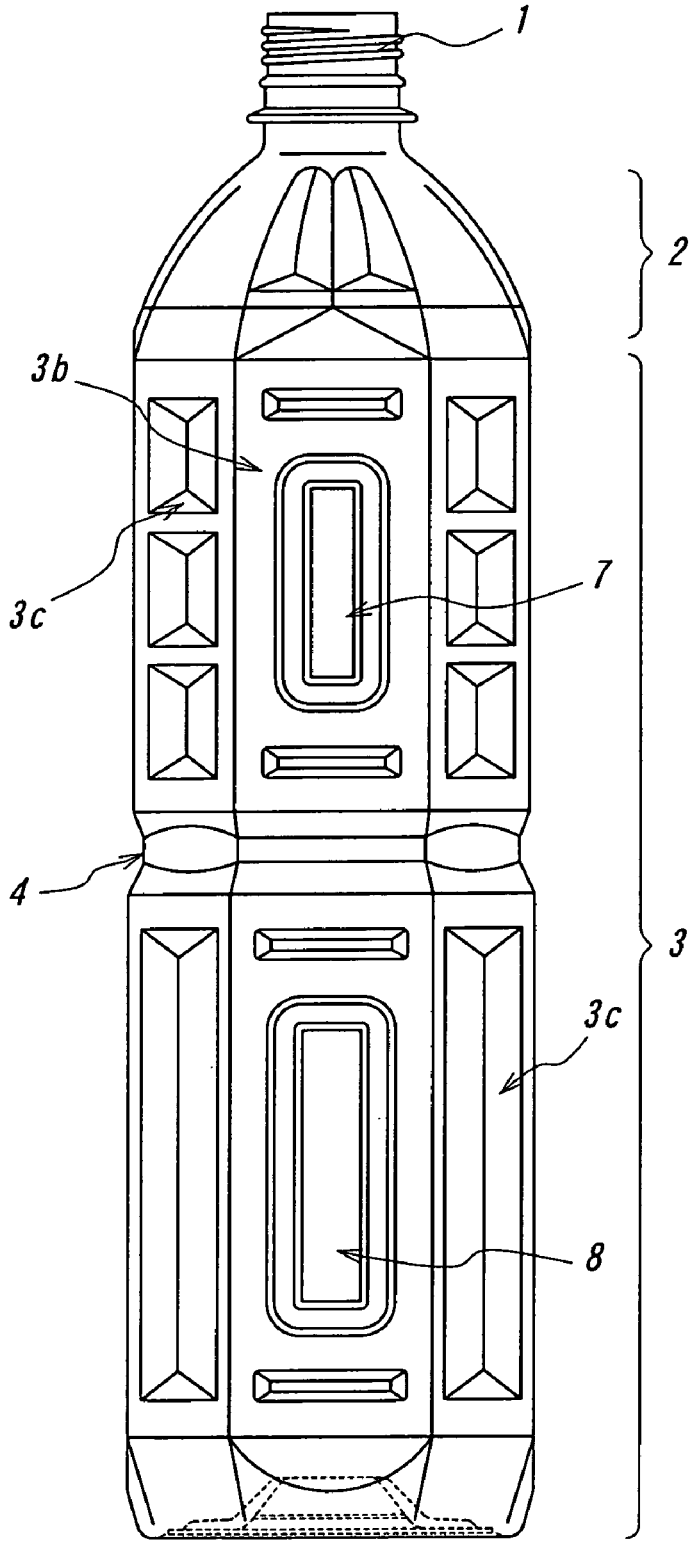
FIGS. 2, 3 and 4 are side view, plan view and bottom view of the container, respectively.
Figure 3:
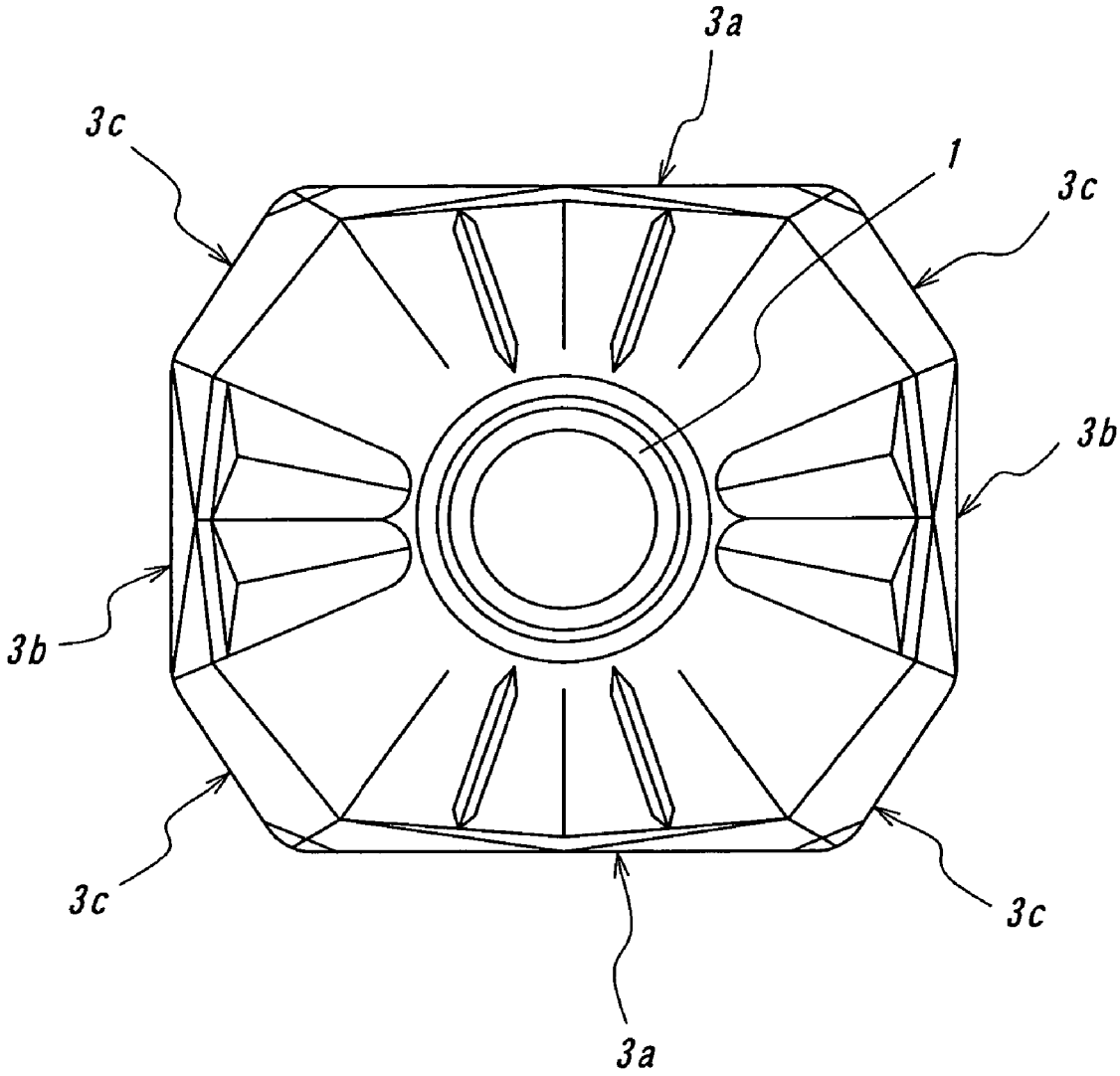
Figure 4:
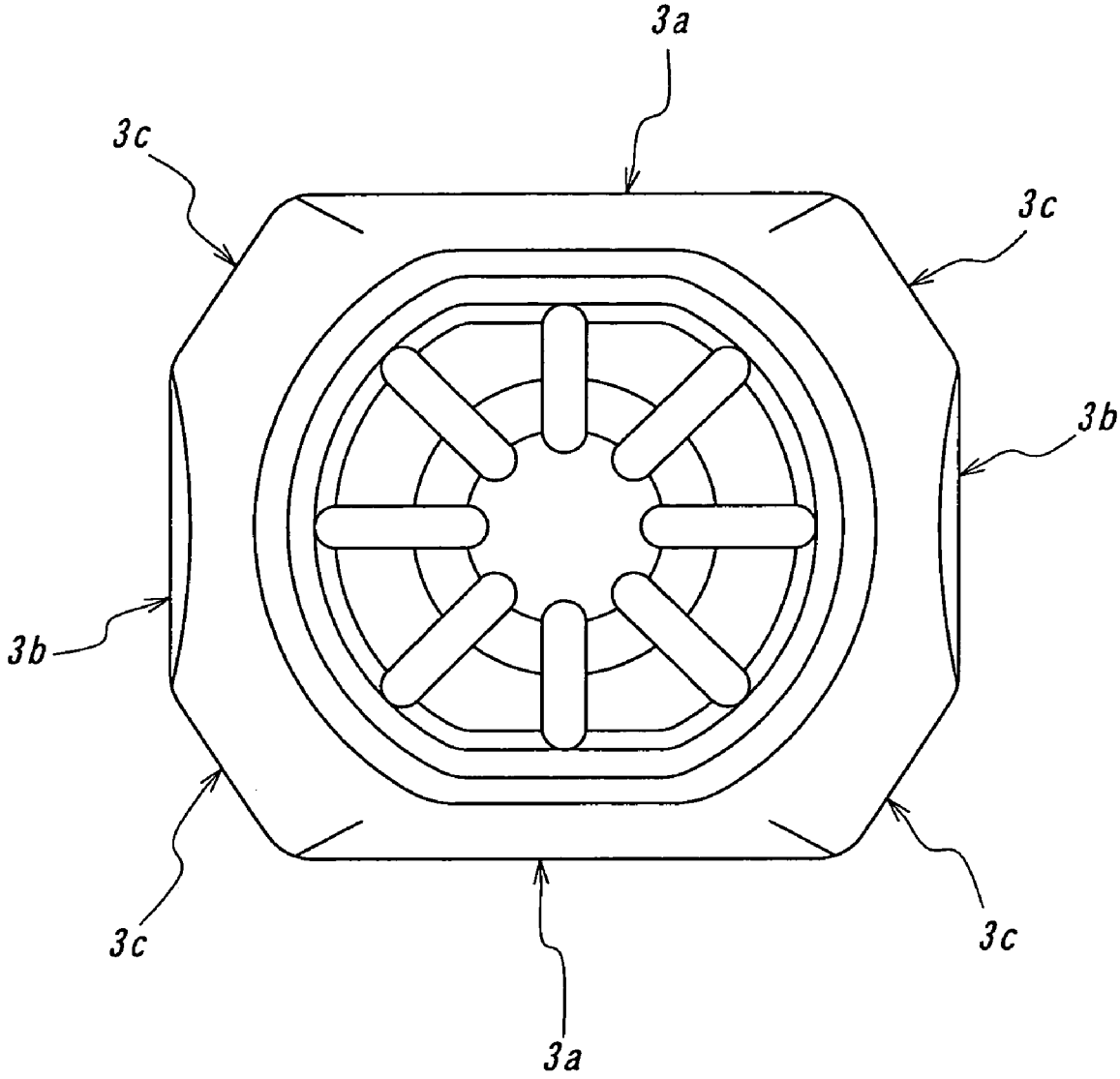

A waisted bottle-type container having a rectangular cross-section according to an embodiment of the invention is shown in FIGS. 1 to 4, wherein reference numeral 1 represents a mouth portion for pouring out the contents, 2 represents a shoulder portion that is continuous with the mouth portion, and 3 represents a body portion forming a space for filling the contents in its region from the shoulder portion 2 to the bottom wall of the container. The body portion 3 has a rectangular cross-section, and is integrally formed by a pair of long-side walls 3*a* placed opposite to each other, and a pair of short-side walls 3*b* similarly placed opposite to each other, and four corner walls 3*c* for connecting the adjoining walls 3*a* and 3*b* at the corners to enhance the buckling resistance of the container.

Reference numeral 4 represents a reinforcing waist portion which extends around the body portion 3 to divide it into upper and lower regions, 5 represents pressure-reduction absorbing panels formed in the upper part of the long-side walls 3*a*, 6 represents pressure-reduction absorbing panels formed in the lower part of the long-side walls 3*a*, 7 represents pressure-reduction absorbing panels formed in the upper part of the short-side walls 3*b*, and 8 represents pressure-reduction absorbing panels formed in the lower part of the short-side walls 3*b*. These panels 5 to 8 have their profiles shown in FIGS. 5*a*, 5*b*, 5*c* to FIGS. 8*a*, 8*b*, 8*c*, respectively. As can be seen from these figures, each panel is defined by grooves M recessed toward the interior of the container so that, when the pressure within the container is reduced, the panels are deflected inwards to thereby prevent the container from deformation.

Figure 5A:
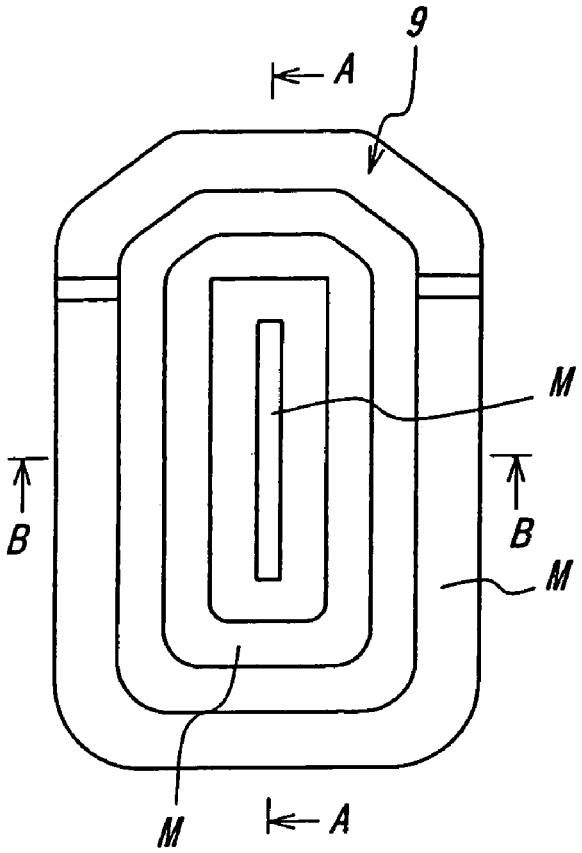
FIGS. 5*a*, 5*b* and 5*c* are front view, longitudinal-sectional view and cross-sectional view of the pressure-reduction absorbing panel 5, respectively.
Figure 5B:
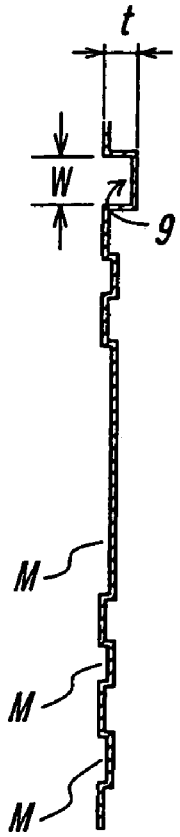
Figure 5C:
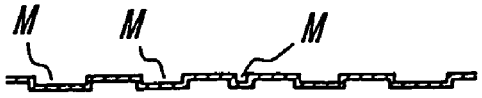
Figure 6A:
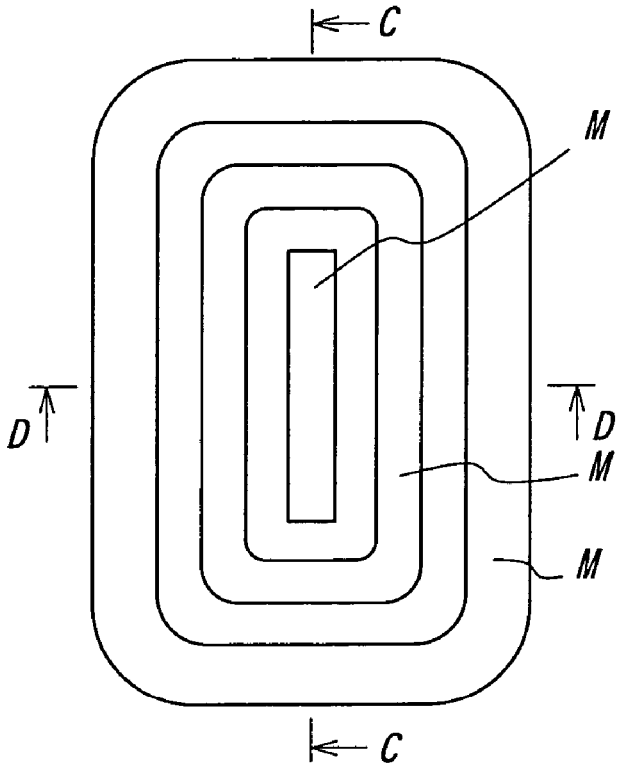
FIGS. 6*a*, 6*b* and 6*c* are front view, longitudinal-sectional view and cross-sectional view of another pressure-reduction absorbing panel 6, respectively.
Figure 6B:
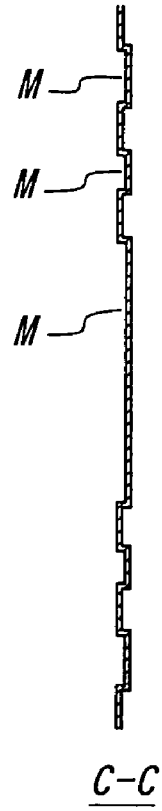
Figure 6C:
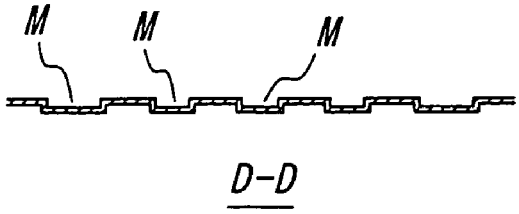
Figure 7A:
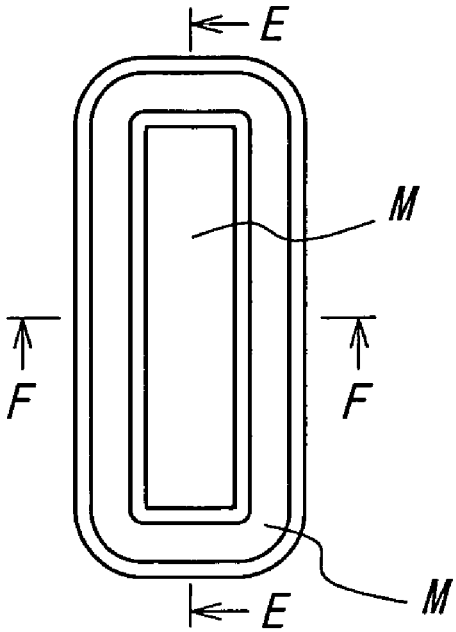
FIGS. 7*a*, 7*b* and 7*c* are front view, longitudinal-sectional view and cross-sectional views of yet another pressure-reduction absorbing panel 7, respectively.
Figure 7B:
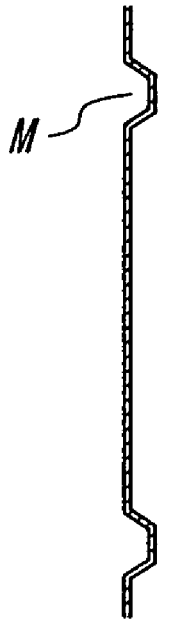
Figure 7C:
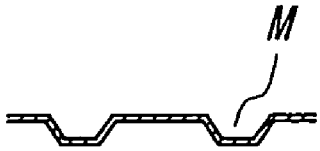
Figure 8A:
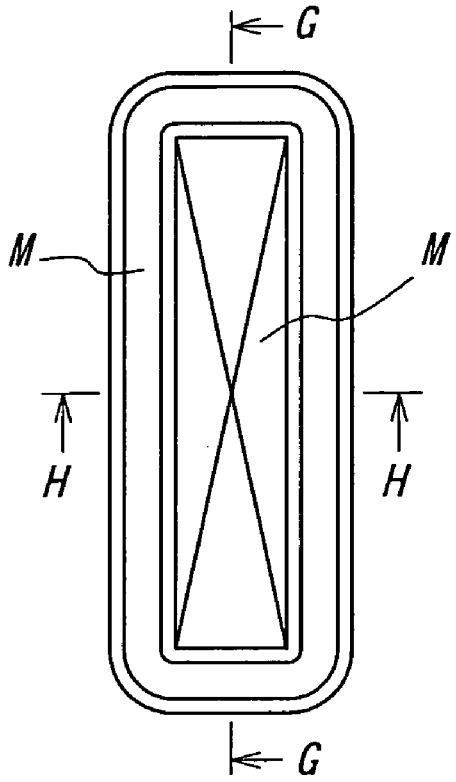
FIGS. 8*a*, 8*b* and 8*c* are front view, longitudinal-sectional view and cross-sectional views of yet another pressure-reduction absorbing panel 8, respectively.
Figure 8B:
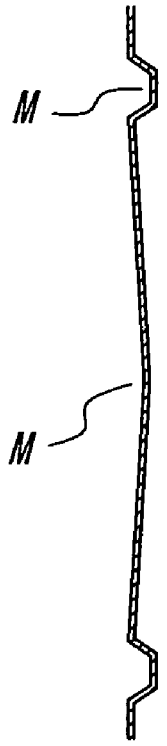
Figure 8C:
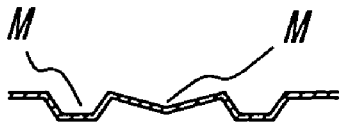

Reference numeral 9 represents a recess continuous with the uppermost groove M (i.e., the groove immediately below the shoulder portion) which defines the uppermost border of the pressure-reduction absorbing panel 5, wherein the depth "t" of the recess 9 is greater than that of the groove M (see FIG. 5*b*).

Figure 9:
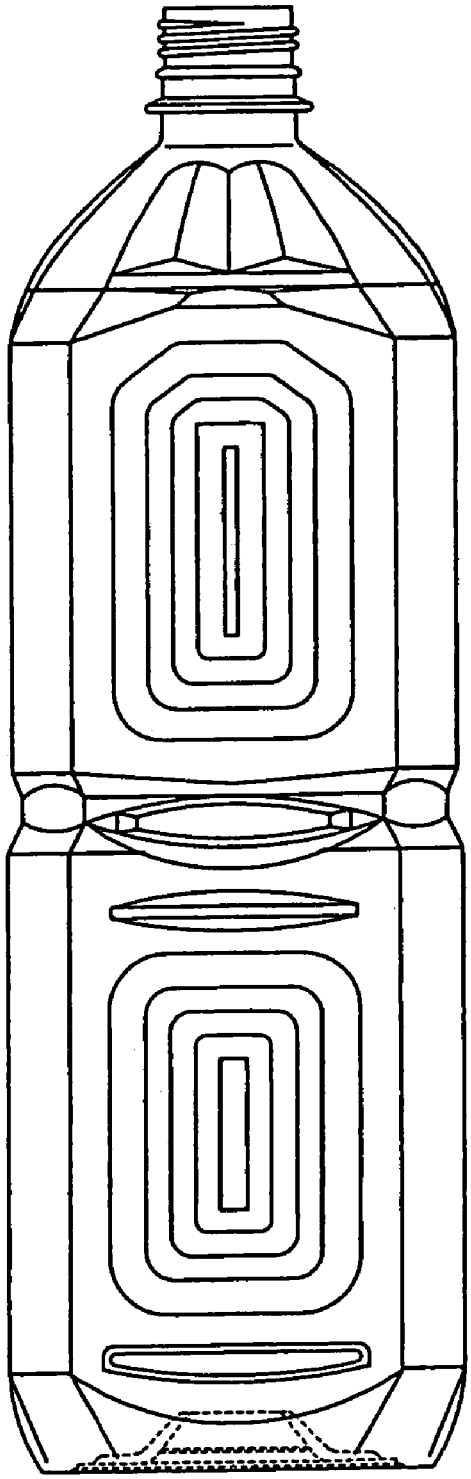
FIG. 9 PRIOR ART
FIG. 9 shows the overview of a control container.

FIG. 9 illustrates a control container having the same rectangular cross-section as that of the container shown in FIGS. 1 to 4. Since this type of containers have a larger surface area in its sides containing long-side walls, the shoulder portion has an increased risk of developing local deformation due to the dislocation of the panels upon absorption of the internal pressure reduction. The occurrence of such local deformation causes the yield to be lowered. On the contrary, the container according to the present invention is provided with the recess 9 at the uppermost groove M of each pressure-reduction absorbing panel 5 and the recess 9 has a depth "t" greater than that of the groove M, to increase the local rigidity and thereby avoid a situation wherein the shoulder portion 2 readily undergoes deformation.

It is preferred that the width "w" of recess 9 is made the same as that of the groove defining the pressure-reduction absorbing panel, in view of the moldability of the container.

The depth "t" and length of recess 9 may be varied as appropriate, provided that the size of the container and/or the function of the pressure-reduction absorbing panel are not affected.

Figure 10A:
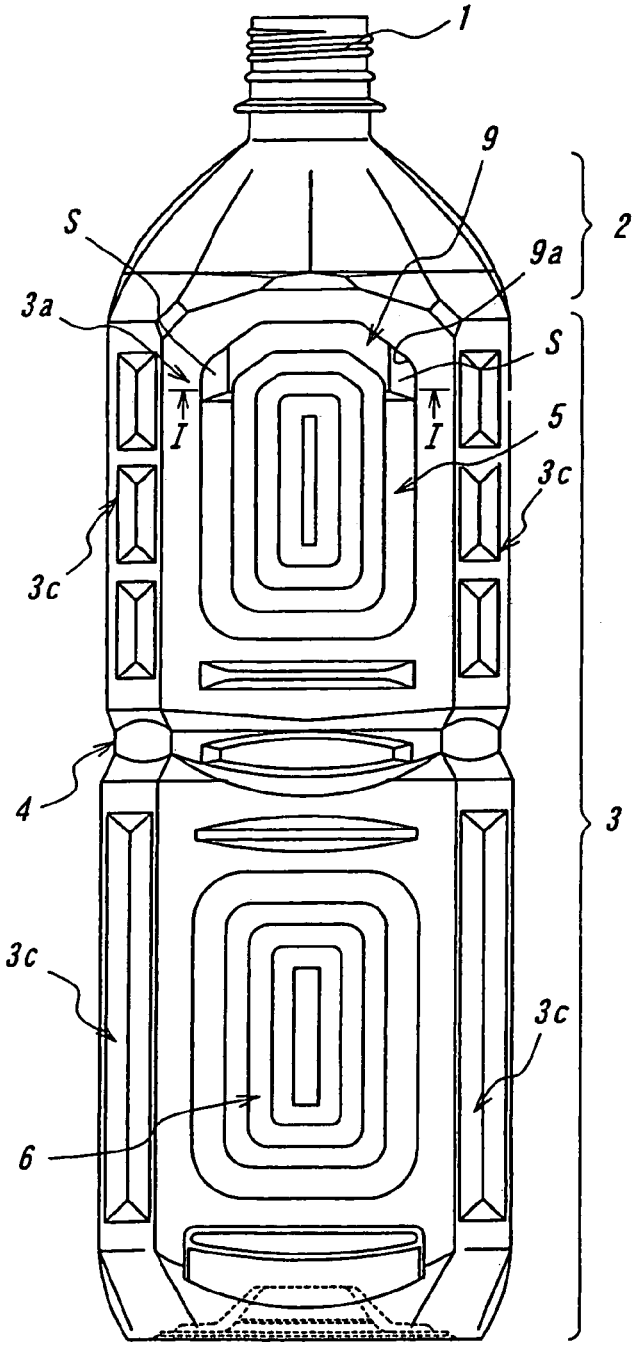
FIG. 10*a* illustrates a container according to another embodiment of the invention.
Figure 10B:
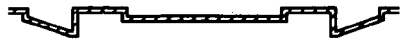
FIG. 10*b* illustrates a cross section through line I—I of the pressure-reduction absorbing panel shown in FIG. 10*a*.

FIGS. 10*a* and 10*b* illustrate a container representing another embodiment of the invention.

When the recess 9 is formed by the blow molding of containers, there may be instances wherein shrinkage is developed in pillar walls 3*c* depending upon the depth "t" and width "w" of the recess 9.

To cope with this problem, there is provided a downward slope S at each outer wall 9*a* of the recess 9 to extend towards the bottom of the recess so as to prevent shrinkage during the blow molding.

1.5 l containers according to the invention as shown in FIGS. 1 to 5 were prepared (the use amount of resin is 55 g, the groove defining each pressure-reduction absorbing panel has a depth of 1.5 mm and width of 7 mm, and the recess 9 has a depth of 4.5 mm and width of 7 mm), and 1.5 l control containers as shown in FIG. 9 were also prepared (the use amount of resin is 55 g, and the groove defining each pressure-reduction absorbing panel has a depth of 1.5 mm and width of 7 mm). These two types of containers were subjected to internal pressure reduction to determine the critical strength to pressure reduction, or the pressure level at which noticeable deformation occurs due to pressure reduction.

As a result, whereas the control container shown in FIG. 9 had its shoulder portion deformed at 41 mmHg, the container according to the invention had its shoulder portion prevented from deformation until the pressure lowered down to 55 mmHg. Thus, it has been confirmed that the resistance to pressure reduction is remarkably improved in the container according to the invention, as compared to the control container.

It will be appreciated from the foregoing description that, according to the present invention, it is possible to reliably prevent the shoulder portions of the container from being deformed due to the absorption of the pressure reduction, and to thereby improve the production yield.

The present invention has been described with reference to the illustrated embodiments on the premise that the container has a rectangular cross-section. However, the present invention is not limited to containers having such a specific configuration, and can also be suitably applied to containers having a circular or polygonal cross-section. Similarly, the capacity of the container is not limited to any specific range, and the invention can also be suitably applied to containers having a capacity that ranges from a volume of as small as 200 ml or 300 ml to a volume larger than 1.5 l, provided that the container has pressure-reduction absorbing panels on its surfaces.

The invention claimed is:

1. A synthetic resin bottle-type container comprising a shoulder portion continuous with a mouth portion through which contents can be poured out, and a body portion forms a space for accommodating the contents over an area extending to its bottom wall from said shoulder portion, said body portion comprising pressure-reduction absorbing panels defined by at least one groove that projects inwards of said container;

said at least one groove comprising a groove for said pressure-reduction absorbing panel which is situated immediately below said shoulder portion, said groove being provided with a recess extending along said groove and having a depth larger than that of the groove.

2. The bottle-type container according to claim 1, wherein said recess has a width which is substantially the same as that of said groove.

3. The bottle-type container according to claim 2, wherein said recess has a slope inclined from its outer surface toward a bottom of said groove, for preventing shrinkage.

4. The bottle-type container according to claim 1, wherein said recess has a slope inclined from its outer surface toward a bottom of said groove, for preventing shrinkage.

* * * * *